United States Patent [19]

Kondo

[11] Patent Number: 4,572,631

[45] Date of Patent: Feb. 25, 1986

[54] DOUBLE SLEEVE DEVELOPING DEVICE

[75] Inventor: Shiroh Kondo, Sagamihara, Japan

[73] Assignee: Ricoh Company, Ltd., Japan

[21] Appl. No.: 592,287

[22] Filed: Mar. 22, 1984

[30] Foreign Application Priority Data

Mar. 22, 1983 [JP] Japan ..... 58-46067
Sep. 27, 1983 [JP] Japan ..... 58-178675

[51] Int. Cl.[4] ..... G03G 15/08
[52] U.S. Cl. ..... 355/3 DD; 355/14 D; 118/658; 430/122
[58] Field of Search ..... 355/3 DD, 14 D, 3 CH, 355/14 CH, 16; 430/122, 121, 120; 118/658, 657, 656

[56] References Cited

U.S. PATENT DOCUMENTS

| | | | |
|---|---|---|---|
| 4,350,432 | 9/1982 | Kondoh | 355/3 DD |
| 4,364,656 | 12/1982 | Yanagawa | 355/14 CH X |
| 4,406,535 | 9/1983 | Sakamoto et al. | 355/3 DD |
| 4,406,536 | 9/1983 | Suzuki et al. | 355/3 DD |
| 4,425,382 | 1/1984 | Tajima | 355/3 DD X |
| 4,449,810 | 5/1984 | Ikesue et al. | 355/3 DD |
| 4,461,238 | 7/1984 | Baier et al. | 355/3 DD X |

OTHER PUBLICATIONS

IBM Technical Disclosure Bulletin, vol. 15, No. 4, Sep. 1972, Freeman et al.

*Primary Examiner*—A. C. Prescott
*Assistant Examiner*—Terry Flower
*Attorney, Agent, or Firm*—Guy W. Shoup

[57] ABSTRACT

A device for developing an electrostatic latent image by applying magnetic toner is provided. The device includes a first transporting sleeve for transporting the magnetic toner along a first transporting path as carried thereon with the toner supplied from a hopper and a second transporting sleeve for transporting the toner along a second transporting path, which passes through a developing station where the latent image is developed, as carried thereon with the toner transferred from the first sleeve at least partly. There are also provided a first doctor blade for forming a first film of toner on the first sleeve and a second doctor blade for forming a second film of toner on the second sleeve. Thus, the toner is conditioned by the first sleeve before being formed into the second film which is actually used at the developing station for development, thereby insuring the high quality, uniform charge distribution, and stable operation of the improved developing device without causing irregularities in density and without background contamination.

17 Claims, 5 Drawing Figures

DOUBLE SLEEVE DEVELOPING DEVICE

BACKGROUND OF THE INVENTION

1. Field of the Invention

This invention relates to a device for developing an electrostatic latent image formed on an imaging surface by applying a developing agent thereto and particularly to a developing device suitable for use in a recording machine, such as a copier, a facsimile machine and a printer, using magnetic toner as a developer agent.

2. Description of the Prior Art

FIG. 1 illustrates a typical prior art developing device using a so-called single component developer, or magnetic toner. As shown, adjacent to a photosensitive drum 1, whose outer peripheral surface defines an imaging surface on which an electrostatic latent image is formed according to any of the well-known electrophotographic image forming processes, is disposed a developing device 2 for developing the latent image formed on the photosensitive drum 1. The developing device 2 includes a hopper 3 for storing therein a quantity of a single component developer or magnetic toner 4, a sleeve 5 disposed rotatably at the bottom of the hopper 3, a magnet 6 disposed inside of the sleeve 6 for generating a magnetic field to cause the magnetic toner 4 to be attracted to the outer peripheral surface of the sleeve 5 and a doctor blade 7 formed by part of the hopper 3 for regulating an amount of toner 4 to be transported as carried on the sleeve 5.

In the above-described developing device, the magnetic toner 4 magnetically attracted to the sleeve 5 is regulated in amount by the doctor blade 7 and then applied to an electrostatic latent image formed on the photosensitive drum 1. As is well known in the art, the magnetic toner 4 becomes triboelectrically charged due to friction with the sleeve 5 and/or the docter blade 7 when formed into a layer on the sleeve 5. Alternatively, a charge injecting means may be provided to inject charge to the toner on the sleeve 5. The film of magnetic toner formed on the sleeve 5 is selectively transferred to the photosensitive drum 1 according to a charge pattern defined by the latent image on the drum surface. The toner remaining on the sleeve 5 after development is then transported back to the hopper 3 as the sleeve 5 rotates counterclockwise. Thus, fresh toner is supplied to those portions of the sleeve 5 where the toner has been used for developing the latent image. Such a structure is disadvantageous because a charge distribution becomes nonuniform thereby causing deteriorations in image quality, such as irregularities in density and background contamination.

SUMMARY OF THE INVENTION

It is therefore a primary object of the present invention to obviate the above-described disadvantages of the prior art.

Another object of the present invention is to provide an improved developing device capable of forming a film of developer uniform in charge distribution prior to application for developing an electrostatic latent image.

A further object of the present invention is to provide a developing device capable of developing an electrostatic latent image without causing irregularities in density and background contaminating, thereby allowing to obtain a developed image of high quality.

A still further object of the present invention is to provide a developing device stable in operation for an extended period of time.

Other objects, advantages and novel features of the present invention will become apparent from the following detailed description of the invention when considered in conjunction with the accompanying drawings.

DESCRIPTION OF THE PREFERRED EMBODIMENTS

Figure 1:
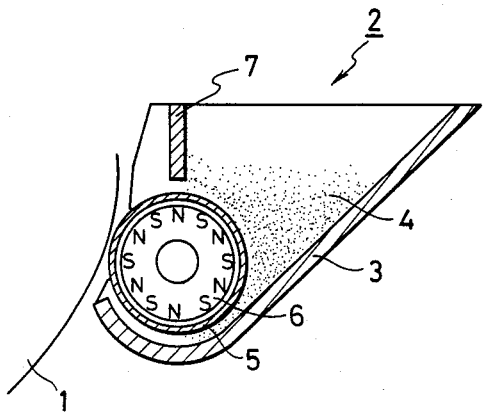
FIG. 1 Prior Art
FIG. 1 is a schematic illustration showing the prior art developing device using magnetic toner.
Figure 2:
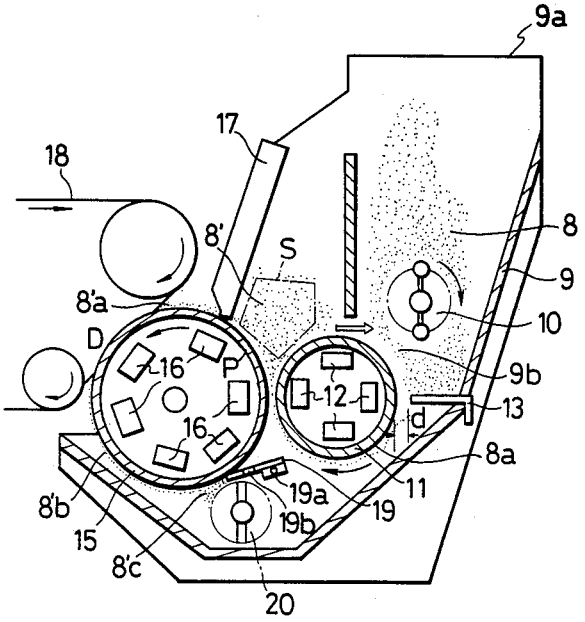
FIG. 2 is a schematic illustration showing a developing device constructed in accordance with one embodiment of the present invention.

Referring now to FIG. 2, there is shown a developing device constructed in accordance with one embodiment of the present invention for developing an electrostatic latent image formed on an imaging surface. As shown, the developing device includes a hopper 9 for storing therein a quantity of fresh, uncharged magnetic toner 8 which is replenished through a top opening 9*a*. A supply port 9*b* is defined at the bottom of the hopper 9 and an agitator 10 is disposed inside of the hopper 9 for stirring the toner 8 inside of the hopper 9 to keep it uniform in property and individually separate. A transport sleeve 11 is disposed at the supply port 9*b* and it is driven to rotate clockwise as indicated by the arrow. Inside of the transport sleeve 11 is disposed a plurality of magnets 12 so that magnetic toner 8 may be carried on the transport sleeve 11 as magnetically attracted thereto.

A first doctor blade is provided at the bottom of the hopper 9 as extending horizontally with its tip end located at a distance d from the peripheral surface of the transport sleeve 11. Thus, when the transport sleeve 11 is driven to rotate clockwise, the magnetic toner 8 supplied to the transport sleeve 11 through the supply port 9*b* as magnetically attracted thereto is regulated in thickness and thus amount of toner to be carried on the transport sleeve 11. Thus, a film 8*a* of toner 8 is formed on the transport sleeve 11. As the transport sleeve 11 rotates, the toner film 8*a* is transported to a position opposite to a developing sleeve 15 which is disposed to the left of the transport sleeve 11 with a predetermined gap therebetween.

The developing sleeve 15 is also rotatably supported and driven to rotate counterclockwise as indicated by the arrow. Inside of the developing sleeve 15 is also disposed a plurality of magnets 16 along the inner peripheral surface of the sleeve 15. Although not shown specifically, the outer peripheral surface of the developing sleeve 15 is covered with an electrically conductive, elastic silicon rubber layer 15*a* having the resistivity of $10^5$ ohms-cm or less. It is to be noted that the magnets 16 inside of the developing sleeve 15 are disposed in a particular magnetic field relation to the magnets 12 inside of the transport sleeve 11 such that the toner may be transferred by flying from the transport sleeve 11 to the developing sleeve 15 at the gap between the sleeves 11 and 15.

A second doctor blade 17 is disposed above the developing sleeve 15 with its tip end pressed against the outer peripheral surface of the developing sleeve 15. Thus, the toner transferred from the transport sleeve 11 to the developing sleeve 15 becomes pressed between second doctor blade 17 and the developing sleeve 15 so that the toner is partly allowed to be transported through the contact between the second doctor blade 17 and the developing sleeve 15 thereby forming a thin film 8*a'* of uniformly charged toner, which, in turn, is used for developing an electrostatic latent image at a developing station D. The toner which has been blocked by the second doctor blade 17 starts to circulate in a space defined between the second doctor blade 17 and the developing sleeve 15 so that a stagnating toner region S is formed in this space. The toner in this region S keeps circulating and mostly remains therein due to magnetic attraction caused mainly by the magnets 16 inside of the developing sleeve 15. However, as the amount of toner in the stagnating region S increases, that portion of the toner which has moved out of the influence of the magnetic attraction of the magnets 16 will move toward the transport sleeve 11 and thus this toner is now attracted again to the transporting sleeve 11 to be transported back into the hopper 8 as indicated by the white arrow.

As also shown in FIG. 2, there is provided an endless imaging belt 18 extending around a plurality of rollers and it advances in the direction indicated by the arrow. The imaging belt 18 has an imaging surface defined at its outer surface, on which an electrostatic latent image is formed by any of the well-known image forming processes. As the imaging belt 18 advances, the latent image formed on the imaging belt 18 comes to a developing station D where the thin film 8*a'* of uniformly charged toner carried on the developing sleeve 15 is applied to the latent image formed on the belt 18. Thus, the latent image on the belt 18 is developed while moving through this developing station D.

Since the toner forming the thin film 8*a'* is only selectively transferred to the imaging belt in accordance with a charge pattern defined by the latent image on the imaging belt 18, there remain residual toner 8'*b* on the developing sleeve 15 after moving past the developing station D. As the developing sleeve 15 further rotates, the residual toner 8'*b* is brought to a point where a scraper 19 is in sliding contact with the developing sleeve 15. The scraper 19 is supported such that it is freely pivotal around a pivot 19*a*, and it is comprised of a magnetic material at least partly. Thus, the scraper 19 normally takes a position such that its tip end is in sliding contact with the outer peripheral surface of the developing sleeve 15 as magnetically attracted by the magnets 16 disposed inside of the developing sleeve 15. As a result, the residual toner 8'*b* is scraped off the developing sleeve 15 by the scraper 19.

A transport roller 20 is provided adjacent to the scraper 19, or immediately below the contact between the developing sleeve 15 and the scraper 19 in the illustrated embodiment. The transport roller 20 does not need to be in rotation at all times, and, in the present embodiment, it is driven to rotate one revolution when the developing sleeve 15 has completed 20 revolutions. Thus, the toner scraped off the developing sleeve 15 by the scraper 19 gradually accumulates in a space below the scraper and the thus accumulated toner 8'*c* is then moved upward by the transport roller 20. The scraper 19 is provided with a plurality of openings 19*b* as arranged in parallel with the rotating axis of the developing sleeve 15 at a predetermined pitch. Thus, the toner moved upward by the transport roller 20 is pushed through the openings 19*b* to be again attracted to the developing sleeve 15. It is to be noted that at least one of the magnets 16 is located such that the toner passing through the openings 19*b* may be effectively attracted to the developing sleeve 15. The toner thus attracted to the developing sleeve 15 is then transported to the stagnating region S is the developing sleeve 15 further rotates.

Therefore, it will be appreciated that in the structure shown in FIG. 2 the newly supplied toner from the transport roller 11 may be well mixed with the recovered toner, which has not been used for developement at the developing station, on the developing sleeve 15 at the stagnating region S, which could greatly contribute to make a charge distribution uniform across the resulting thin film 8*a'*. In other words, in accordance with the present invention, the fresh toner 8 is not directly supplied to the developing sleeve 15, but the fresh toner 8 is first supplied to the transport sleeve 11 to be subjected to a preliminary charging and film forming process in cooperation with the first doctor blade 13 thereby relaxing irregularities in charge and density originally possessed by the fresh toner 8. For this purpose, the gap d between the tip end of the first doctor blade 13 and the transport sleeve 11 is preferably set at $0.3 \pm 0.2$ mm. The preliminarily conditioned toner is then mixed with the returning toner, which has not been used in the last development process, at the stagnating region S. As a result, the toner 8' within the stagnating region S is quite uniform in charge and size distributions.

The toner 8' within the stagnating region S is well mixed and uniform in charge and it is partly fed into the contact between the developing sleeve 15 and the second doctor blade 17. As described previously, the tip end of the second doctor blade 17 is in sliding contact under pressure with the outer peripheral surface of the developing sleeve 15; however, since the silicon rubber cover layer 15*a* is provided at the outer peripheral surface of the sleeve 15, the toner 8' is forced to pass through the contact between the sleeve 15 and the blade 17 at a predetermined rate thereby forming the extremely thin toner film 8*a'*. When formed into the thin film 8*a'*, the toner is sufficiently and uniformly charged.

Figure 3:
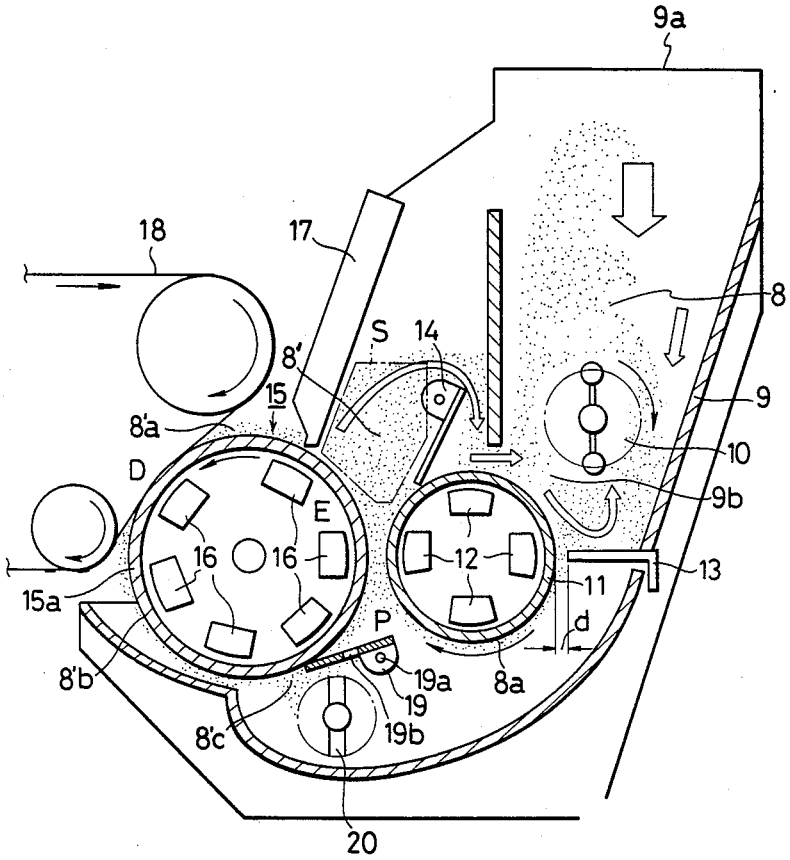
FIG. 3 is a schematic illustration showing a developing device constructed in accordance with another embodiment of the present invention.

FIG. 3 shows another embodiment of the present invention which is a modification of the structure shown in FIG. 2. As is clear when FIGS. 2 and 3 are compared, these two embodiments are virtually the same excepting that an additional scraper 14 is provided in the structure of FIG. 3. That is, in the structure of FIG. 3, the additional scraper 14 is pivotally provided with its tip end in sliding contact with the peripheral surface of the transport sleeve 11. In this case, the toner forming a film 8*a* on the transporting sleeve 11 is partly transferred to the developing sleeve 15 as flying through the space between the two sleeves 11 and 15. For this purpose, the gap between the two sleeves 11 and 15 may, for example, be set in the order of 2–6 mm. The toner which has not been transferred to the developing sleeve 15 and thus is still remaining on the transport sleeve 11 comes to be forcibly scraped off the sleeve 11 by the scraper 14 into the stagnating region S.

Figure 4:
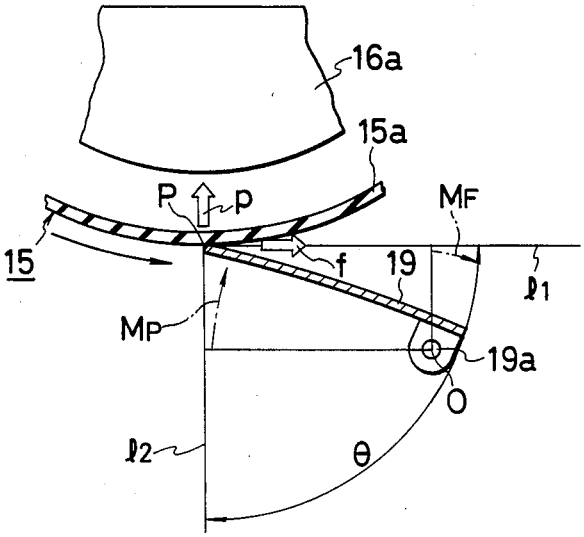
FIGS. 4 and 5 are schematic illustrations useful for explaining the manner of providing the scraper 19 in the developing device shown in FIG. 3.

Now, referring particularly to FIGS. 4 and 5, a preferred manner of providing the scraper 19 will be described in detail. FIG. 4 shows a preferred embodiment in which the pivot 19*a*, or more exactly its pivotal axis O, is located within an angle $\theta$ formed between a line $1_1$ extending tangentially from a contact line P between the developing sleeve 15 and the tip end of the scraper 19 and a line $1_2$ which extends from the contact line P perpendicularly to line $1_1$. Thus, in effect, the angle $\theta$ is 90° in the illustrated embodiment.

Described more in detail, when the pivot 19*a* is located in the above-mentioned angle $\theta$ as shown in FIG. 4, the tip end of the scraper 19 is pressed against the sleeve 15 by a magnetic attractive force p produced by the magnet 16*a* and thus its moment $M_P$ acting on the scraper 19 around the pivotal axis O is clockwise. In addition, a moment $M_F$ acting on the scraper 19 due to a friction f between the sleeve 15 and the scraper 19 is also directed clockwise around the pivotal axis O. Thus, the resultant moment $M_T$ acting on the scraper 19 is a sum of these two component moments and it is also directed clockwise around the pivotal axis O.

Figure 5:
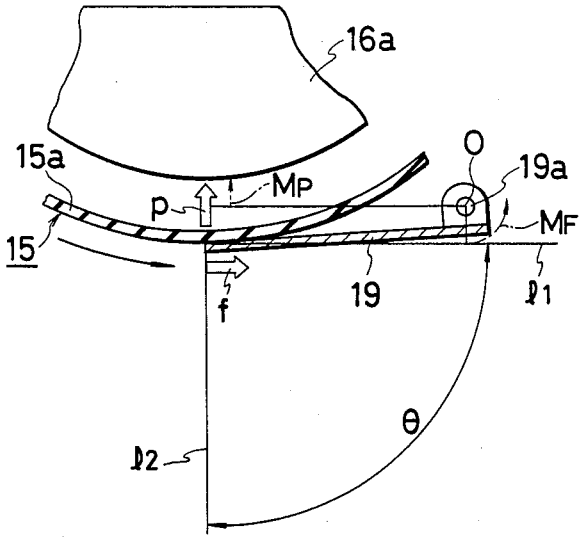

On the other hand, in the case where the scraper 19 is so provided with its pivot 19*a* located outside of the region expansed by the angle $\theta$ as shown in FIG. 5, the moment $M_P$ caused by the magnetic force p acts clockwise on the scraper 19, but the moment $M_F$ caused by the friction f acts counterclockwise on the scraper 19. As a result, a net moment in this case is determined by a subtraction between the two component moments $M_P$ and $M_F$. Accordingly, depending upon the magnitude of frictional force f and the position of pivot 19*a*, the net moment $M_T$ becomes counterclockwise and thus the scraper 19 tends to pivot counterclockwise thereby impairing a scrape-off function to be provided by the scraper 19.

It is thus obvious that, by providing the scraper 19 as shown in FIG. 4, the scraper 19 can properly absorb fluctuations or irregularities in the frictional force f and the thickness of toner film 8'*b*, thereby allowing to provide an intended scrape-off function stably for an extended period of time. It should also be noted that tolerances in manufacture are significantly relaxed in the present structure.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is

1. A developing device for developing a latent image on an image carrier at a developing region, comprising:

storing means for storing a developing agent; first transporting means for transporting said developing agent as carried thereon along a first predetermined path when supplied from said storing means;

second transporting means disposed adjacent to said first transporting means substantially horizontally for transporting said developing agent as carried thereon along a second predetermined path by receiving said developing agent from said first transporting means at least partly, said second predetermined path extending through said developing region;

first regulating means for regulating the amount of said developing agent to be supplied to said developing region as carried on said second transporting means, said first regulating means being disposed above and in contact with said second transporting means thereby defining a stagnating region, together with said first and second transporting means, where said developing agent stagnates at least partly; and scraping means for scraping off said developing agent remaining on said second transporting means after passing through said developing region.

2. A developing device of claim 1 further comprising (first) second regulating means for regulating the amount of said developing agent to be supplied from said storing means to said first transporting means (and second regulating means for regulating the amount of said developing agent to be supplied to said developing agent as carried on said second transporting means).

3. A developing device of claim 2 wherein said (first) second regulating means includes a first doctor blade having its tip end located at a predetermined distance separated away from said first transporting means thereby allowing to form a film of developing agent of a first thickness on said first transporting means and said (second) first regulating means includes a second doctor blade having its tip end pressed against said second transporting means thereby allowing to form a film of charged developing agent of a second thickness on said second transporting means.

4. A developing device of claim3 wherein said second transporting means includes a silicon rubber cover layer on its carrier surface and the tip end of said second doctor blade is pressed against said second transporting means in sliding contact with said silicon rubber cover layer.

5. A developing device of claim4 wherein said silicon rubber is electrically conductive and has a resistivity of $10^5$ ohms-cm or less.

6. A developing device of claim3 wherein said first transporting means includes a first transporting sleeve which is driven to rotate in a first direction and said second transporting means includes a second transporting sleeve which is driven to rotate in -a second direction which is opposite to said first direction.

7. A developing device of claim6 wherein said first and second transporting sleeves are arranged with a predetermined gap therebetween such that said developing agent carried on said first transporting sleeve may be transferred to said second transporting sleeve at least partly.

8. A developing device of claim7 wherein said developing agent includes magnetic toner and said device further comprises first magnet means disposed inside of said first transporting sleeve and second magnet means disposed inside of said second transporting sleeve so that said magnetic toner may be carried on said first and second transporting sleeves as magnetically attracted thereto.

9. A developing device of claim8 wherein said scraping means includes a magnetically attractable', pivotally supported scraper having its tip end pressed against said second transporting sleeve as magnetically attracted by . said second magnet means.

10. A developing device of claim9 wherein said scraper is provided with at least one opening thereby allowing said developing agent scraped off said second transporting sleeve to be again carried on said second transporting sleeve after passing through said opening.

11. A developing device of claim 10 further comprising third transporting means for transporting the magnetic toner scraped off said second transporting sleeve to said second transporting sleeve again through said opening.

12. A developing device of claim8 wherein said first magnet means includes a first plurality of magnets disposed inside of said first transporting sleeve and said second magnet means includes a second plurality of magnets disposed inside of said second transporting sleeve whereby said first and second plurality of magnets are arranged at least partly such that said magnetic toner carried on said first transporting sleeve may be transferred to said second transporting sleeve as flying a gap therebetween.

13. A developing device of claim9 wherein said scraper is pivotally supported at a pivot which is located in an area defined between a tangential line at a contact between said scraper and said second transporting sleeve and a line perpendicular to said tangential line at said contact.

14. A developing device of claim13 wherein said pivot is located at -a downstream side of said perpendicular line with respect to the direction of rotation of said second transporting sleeve.

15. A developing device for developing a latent image on an image carrier at a developing region, comprising:

storing means for storing a developing agent; first transporting means for transporting said developing agent as carried thereon along a first predetermined path when supplied from said storing means;

second transporting means for transporting said developing agent as carried thereon along a second predetermined path by receiving said developing agent from said first transporting means at least partly, said second predetermined path extending through said developing region; and scraping means for scraping off said developing agent remaining on said second transporting means after passing through said developing region further comprising first regulating means for regulating the amount of said developing agent to be supplied from said storing means to said first transporting means and second regulating means for regulating the amount of said developing agent to be supplied to said developing agent as carried on said second transporting means wherein said first regulating means include a first doctor blade having its tip end located at a predetermined distance separated away from said first transporting means thereby allowing to form a film of developing agent of a first thickness on said first transporting means and said second regulating means includes a second doctor blade having its tip end pressed against said second transporting means thereby allowing to form a film of charged developing agent of a second thickness on said second transporting means wherein said second transporting means includes a silicon rubber cover layer on its carrier surface and the tip end of said second doctor blade is pressed against said second transporting means in sliding contact with said silicon rubber cover layer.

16. A developing device of claim 15 wherein said silicon rubber is electrically conductive and has a resistivity of $10^5$ ohms-cm or less.

17. A developing device for developing a latent image on an image carrier at a developing region, comprising:

storing means for storing a developing agent; first transporting means for transporting said developing agent as carried thereon along a first predetermined path when supplied from said storing means;

second transporting means for transporting said developing agent as carried thereon along a second predetermined path by receiving said developing agent from said first transporting means at least partly, said second predetermined path extending through said developing region; and scraping means for scraping off said developing agent remaining on said second transporting means after passing through said developing region further comprising first regulating means for regulating thamount of said developing agent to be suppoied from said storing means to said first transporting means and second regulating means for regulating the amount of said developing agent to be supplied to said developing agent as carried on said second transporting means wherein said first regulating means includes a first doctor blade having its tip end located at a predetermined distance separated away from said first transporting means thereby allowing to form a film of developing agent of a first thickness on said first transporting means and said second regulating means includes a second doctor blade having its tip end pressed against said second transporting means thereby allowing to form a film of charged developing agent of a second thickness on a said second transporting means wherein said first transporting means includes a first transporting sleeve which is driven to rotate in a first direction and said second transporting means includes a second transporting sleeve which is driven to rotate in a second direction which is opposite to said first direction, wherein said first and second transporting sleeve are arranged with a predetermined gap therebetween such that said developing agent carried on said first transporting sleeve may be transferred to said second transporting sleeve at least partly wherein said developing agent includes magnetic toner and said device further comprises first magnet means disposed inside of said first transporting sleeve and second magnet means disposed inside of said second transporting so that said magnetic toner may be carried on said first and second transporting sleeves as magnetically attrated thereto, wherein said scraping means includes a magnetically attractable, pivotally supported scraper having its tip end pressed against said second transporting sleeve as magnetically attracted by said second magnet means wherein said scraper is provided with at least one opening thereby allowing said developing agent scraped off said second transporting sleeve to be again carried on said second transporting sleeve after passing through said opening comprising third transporting means for transporting the magnetic toner scraped off said second transporting sleeve to said second transporting sleeve again through said opening.

* * * * *